US009039385B2

(12) United States Patent
Myers et al.

(10) Patent No.: US 9,039,385 B2
(45) Date of Patent: May 26, 2015

(54) JET PUMP ASSEMBLY

(75) Inventors: Eric Myers, Howell, MI (US); Syed K. Ali, Dearborn, MI (US); Robert Hornblower Meyer, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 735 days.

(21) Appl. No.: 13/305,620

(22) Filed: Nov. 28, 2011

(65) Prior Publication Data

US 2013/0133870 A1 May 30, 2013

(51) Int. Cl.
*F04F 5/46* (2006.01)
*F02M 37/02* (2006.01)
*F01P 11/04* (2006.01)

(52) U.S. Cl.
CPC ..... *F02M 37/025* (2013.01); *F04F 5/46* (2013.01); *F01P 11/04* (2013.01)

(58) Field of Classification Search
CPC ..... F04F 5/46; F04F 5/463
USPC ..... 417/151, 194, 197, 198
See application file for complete search history.

(56) References Cited

U.S. PATENT DOCUMENTS 541,871 A * 7/1895 Wheeler ..... 237/44
1,724,625 A * 8/1929 Sweeny ..... 417/183
2,310,265 A * 2/1943 Sweeny ..... 406/194
3,045,897 A * 7/1962 Wood ..... 417/54
3,987,628 A 10/1976 Gassman
4,037,991 A 7/1977 Taylor
4,066,385 A 1/1978 Diebold
4,101,246 A 7/1978 Erickson
4,135,861 A 1/1979 Brown et al.
4,183,713 A 1/1980 Erickson et al.
4,222,763 A 9/1980 McMaster
4,274,812 A 6/1981 Elvidge et al.
4,285,638 A 8/1981 Clark
4,285,770 A 8/1981 Chi et al.
4,325,219 A 4/1982 Stang et al.
4,385,594 A 5/1983 Hauser
4,429,476 A 2/1984 Wakefield
4,461,678 A 7/1984 Matthews et al.

(Continued)

FOREIGN PATENT DOCUMENTS

WO 9739297 10/1997

OTHER PUBLICATIONS

Bond, Geoffrey et al., "Selection of the Optimized Aftercooling System for Cummins Premium Diesel Engines," SAE Technical Paper Series No. 841023, West Coast International Meeting & Exposition, San Diego, CA, Aug. 6-9, 1984, 11 pages.

(Continued)

*Primary Examiner* — Peter J Bertheaud
(74) *Attorney, Agent, or Firm* — James Dottavio; Alleman Hall McCoy Russell & Tuttle LLP

(57) ABSTRACT

A system for an engine is provided herein. The system includes a primary passage, a suction passage, and an outer casing coupling the primary and suction passages such that a primary axis is orthogonal to a suction axis. The system further includes a jet pump assembly coupled to the primary passage forming an annular channel between the outer casing and the jet pump assembly. Further, the jet pump assembly includes a flow divider positioned opposite from the suction passage within the annular channel.

12 Claims, 4 Drawing Sheets

(56) References Cited

U.S. PATENT DOCUMENTS

| | | | | |
|---|---|---|---|---|
| 4,468,172 | A | 8/1984 | Dixon et al. | |
| 4,487,553 | A | 12/1984 | Nagata | |
| 4,558,990 | A | 12/1985 | Roach | |
| 4,631,004 | A | 12/1986 | Mock | |
| 4,632,649 | A | 12/1986 | Segebrecht et al. | |
| 4,762,467 | A | 8/1988 | Ackermann et al. | |
| 4,810,170 | A | 3/1989 | Ide | |
| 4,834,132 | A | 5/1989 | Sasaki et al. | |
| 4,881,875 | A | 11/1989 | Adkins | |
| 4,921,406 | A | 5/1990 | Bürger | |
| 4,938,665 | A | 7/1990 | Volkmann | |
| 4,940,392 | A | 7/1990 | Adkins | |
| 5,024,583 | A | 6/1991 | Sasaki et al. | |
| 5,082,426 | A | 1/1992 | Sasaki et al. | |
| 5,088,896 | A | 2/1992 | Nielsen et al. | |
| 5,372,190 | A | 12/1994 | Coleman | |
| 5,444,747 | A | 8/1995 | Terhune | |
| 5,667,366 | A | 9/1997 | Reef et al. | |
| 5,788,667 | A | 8/1998 | Stoller | |
| 5,820,353 | A | 10/1998 | Beylich et al. | |
| 5,954,481 | A * | 9/1999 | Baier et al. | 417/182 |
| 6,059,682 | A | 5/2000 | Friedmann et al. | |
| 6,068,022 | A | 5/2000 | Schultz et al. | |
| 6,068,565 | A | 5/2000 | Riemer et al. | |
| 6,119,902 | A | 9/2000 | Shimada et al. | |
| 6,168,388 | B1 | 1/2001 | Hughes et al. | |
| 6,171,069 | B1 | 1/2001 | Levitin et al. | |
| 6,270,321 | B1 | 8/2001 | Schulte | |
| 6,296,454 | B1 | 10/2001 | Schmid et al. | |
| 6,357,541 | B1 | 3/2002 | Matsuda et al. | |
| 6,364,625 | B1 | 4/2002 | Sertier | |
| 6,450,275 | B1 | 9/2002 | Gabriel et al. | |
| 6,450,775 | B1 | 9/2002 | Hutchinson et al. | |
| 6,457,442 | B1 | 10/2002 | Fuchs et al. | |
| 6,619,927 | B1 | 9/2003 | Becker et al. | |
| 6,824,484 | B2 | 11/2004 | Greiter | |
| 7,040,303 | B2 | 5/2006 | Uzkan et al. | |
| 7,128,025 | B1 | 10/2006 | Westhoff et al. | |
| 8,136,361 | B2 * | 3/2012 | Schott et al. | 60/782 |
| 2005/0129527 | A1 | 6/2005 | Kimisawa et al. | |
| 2006/0207855 | A1 | 9/2006 | Arnold et al. | |

OTHER PUBLICATIONS

Schatzle, Jason et al., "Minimizing Power Consumption of an HEV Cooling System," Final Report for ME 555, University of Michigan, Apr. 18, 1995, 24 pages.

* cited by examiner

JET PUMP ASSEMBLY

BACKGROUND AND SUMMARY

Vehicles may use a jet pump to provide a fluid to various systems in an internal combustion engine. For example, a jet pump may be used to pump fuel through a fuel delivery system, to pump coolant through a cooling system, etc. Jet pumps incorporate the Venturi effect by utilizing a pressure force to increase a velocity of a motive fluid. In doing so, a low pressure zone is created and a suction fluid is entrained into a main flow of the motive fluid. As such, the motive fluid and the suction fluid mix within a region coinciding with the two fluids converging.

For example, U.S. Pat. No. 4,834,132 describes a jet nozzle for a fuel supply system. The system includes a fuel nozzle, a pressure chamber that encompasses the fuel nozzle, and an ejector pump upstream from the fuel nozzle. The ejector pump enables a fluid to be discharged from the nozzle and creates a negative pressure within the pressure chamber to suction fluid into pressure chamber. The fluid discharged from the nozzle and the fluid suctioned into the pressure chamber converges within a converging portion.

The inventors herein have recognized various issues with the above system. In particular, mixing of the fluid discharged from the nozzle and the fluid from the pressure chamber involves a lengthy converging portion.

As such, one example approach to address the above issues is to provide a flow divider that streamlines a suctioned fluid flow prior to converging with a fluid released from a jet nozzle. In this way, it is possible to align the suctioned fluid flow with a primary flow direction, prior to the suctioned flow entering a mixing region downstream from the jet nozzle. In one embodiment, the flow divider may be positioned opposite from a suction passage opening, such that the jet nozzle is positioned between the flow divider and the opening. Further, the flow divider may include a flow divider portion and a streamline portion. This example configuration enables the suctioned fluid to be entrained nearly semi-circumferentially around the nozzle such that a flow pathway is directed by the flow divider portion and aligned with the primary flow direction by the streamline portion. Thus, by taking advantage of the flow divider, a higher primary flow rate for a given pressure can be achieved.

Note that the flow divider may have various suitable geometries, including having a fin shape or another shaped extending protuberance. Further, a jet pump assembly apparatus may include more than one flow divider, if desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to jet pump assembly that includes a nozzle and a flow divider positioned within an outer casing of the jet pump assembly, which are arranged in such a way that suctioned fluid is streamlined with a primary flow direction prior to entering a mixing region downstream from the nozzle. Further, a suction passage may be arranged on an opposite side of the nozzle from the flow divider. In this way, a central axis of the suction passage may be orthogonal to a primary flow direction. This arrangement allows suctioned fluid to be entrained nearly semi-circumferentially around an exterior of the nozzle such that the suction fluid is diverted by a divider portion of the flow divider and aligned with the primary flow direction by a streamline portion of the flow divider. Various flow divider geometries may be included in the disclosed system. For example, the flow divider may include a fluid contact surface in an upstream region that directs the fluid flow. Further, the flow divider may include a tapered vane portion at a downstream region that follows a contour of the nozzle. Additionally, the flow divider may be coupled to the outer casing such that a gap is not formed between the flow divider and the outer casing, in some portions.

Figure 1:
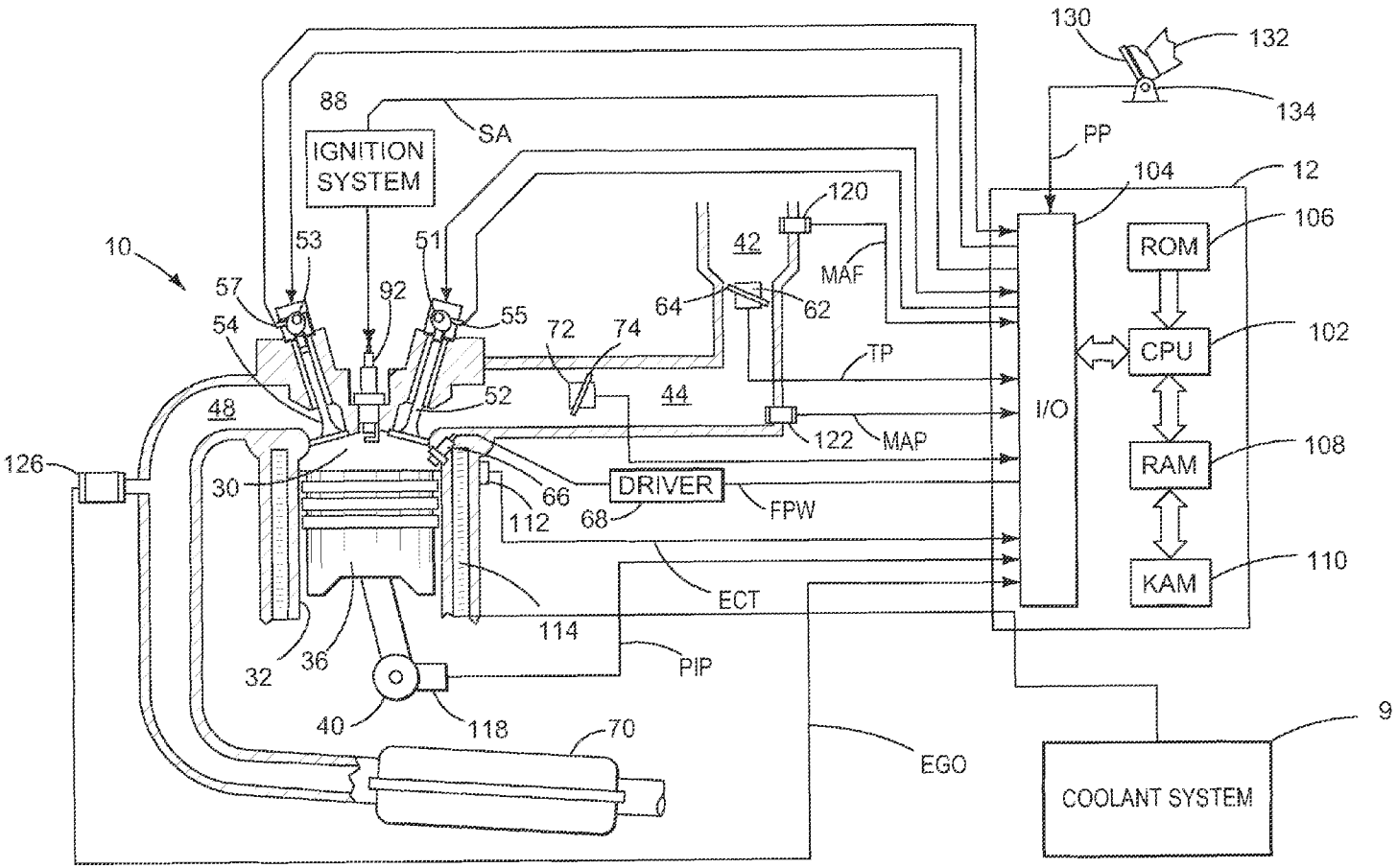
FIG. 1 shows a schematic diagram of an example engine including a coolant system according to an embodiment of the present disclosure.

FIG. 1 shows a schematic diagram showing one cylinder of multi-cylinder internal combustion engine 10. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion cylinder 30 of engine 10 may include combustion cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion cylinder 30 may receive intake air from intake manifold 44 via intake passage 42 and may exhaust combustion gases via exhaust passage 48. Intake manifold 44 and exhaust passage 48 can selectively communicate with combustion cylinder 30 via respective intake valve 52 and exhaust valve 54. In some embodiments, combustion cylinder 30 may include two or more intake valves and/or two or more exhaust valves.

In this example, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion cylinder 30 for injecting fuel directly therein in proportion to the pulse width of signal FPW received from controller 12 via electronic driver 68. In this manner, fuel injector 66 provides what is known as direct injection of fuel into combustion cylinder 30. The fuel injector may be mounted on the side of the combustion cylinder or in the top of the combustion cylinder, for example. Fuel may be delivered to fuel injector 66 by a fuel delivery system (not shown) including a fuel tank, a fuel pump, and a fuel rail. In some embodiments, combustion cylinder 30 may alternatively or additionally include a fuel injector arranged in intake passage 42 in a configuration that provides what is known as passage injection of fuel into the intake passage upstream of combustion cylinder 30.

Intake passage 42 may include a charge motion control valve (CMCV) 74 and a CMCV plate 72 and may also include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 42 may include a mass air flow sensor 120 and a manifold air pressure sensor 122 for providing respective signals MAF and MAP to controller 12.

Exhaust gas sensor 126 is shown coupled to exhaust passage 48 upstream of catalytic converter 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may include light-off catalysts and underbody catalysts, as well as exhaust manifold, upstream and/or downstream air-fuel ratio sensors. Catalytic converter 70 can include multiple catalyst bricks, in one example. In another example, multiple emission control devices, each with multiple bricks, can be used. Catalytic converter 70 can be a three-way type catalyst in one example.

Controller 12 is shown in FIG. 1 as a microcomputer, including microprocessor unit 102, input/output passages 104, an electronic storage medium for executable programs and calibration values shown as read only memory chip 106 in this particular example, random access memory 108, keep alive memory 110, and a data bus. The controller 12 may receive various signals and information from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Storage medium read-only memory 106 can be programmed with computer readable data representing instructions executable by processor 102 for performing the methods described below as well as variations thereof. The engine cooling sleeve 114 is coupled to a coolant system 9.

Coolant system 9 may include a jet pump assembly to distribute coolant to various components of engine 10. For example, coolant may be pumped through an engine block, which may include cooling sleeve 114. As another example, coolant may be pumped through a cylinder head block that houses the aforementioned intake and exhaust valves. It will be appreciated that coolant system 9 may distribute coolant to other components of engine 10 in addition and/or alternative to the examples provided above.

As described in more detail below, the jet pump assembly may be configured to streamline a suction flow upstream from a mixing region to thereby enable a higher primary flow rate for a given pressure. Such a jet pump assembly is described below with reference to FIGS. 2-4.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

As described above, FIG. 1 shows only one cylinder of a multi-cylinder engine, and each cylinder may similarly include its own set of intake/exhaust valves, fuel injector, ignition system, coolant system etc.

Figure 2:
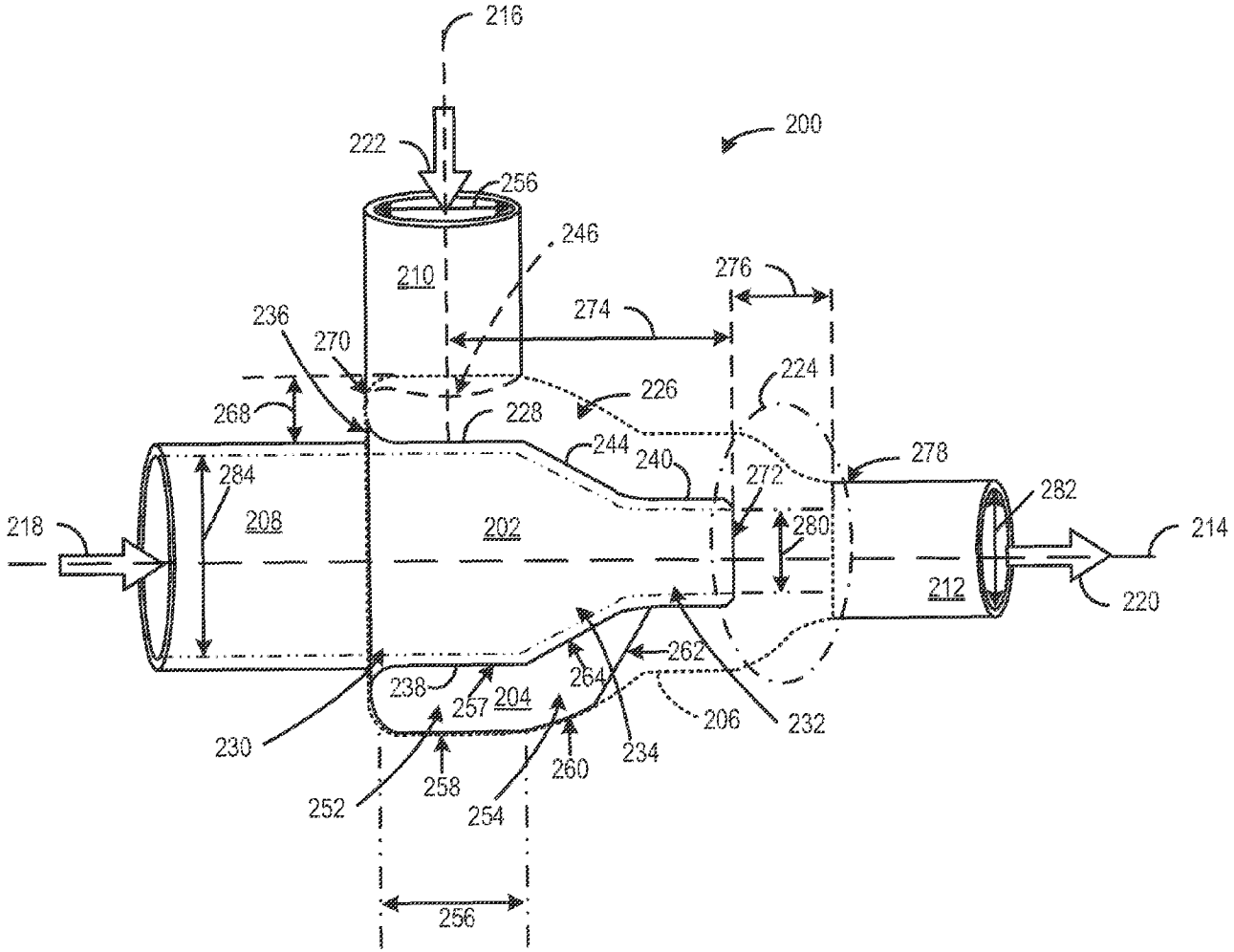
FIG. 2 shows a side perspective view of an example jet pump nozzle assembly that may be included in the coolant system of FIG. 1 according to an embodiment of the present disclosure.
Figure 3:
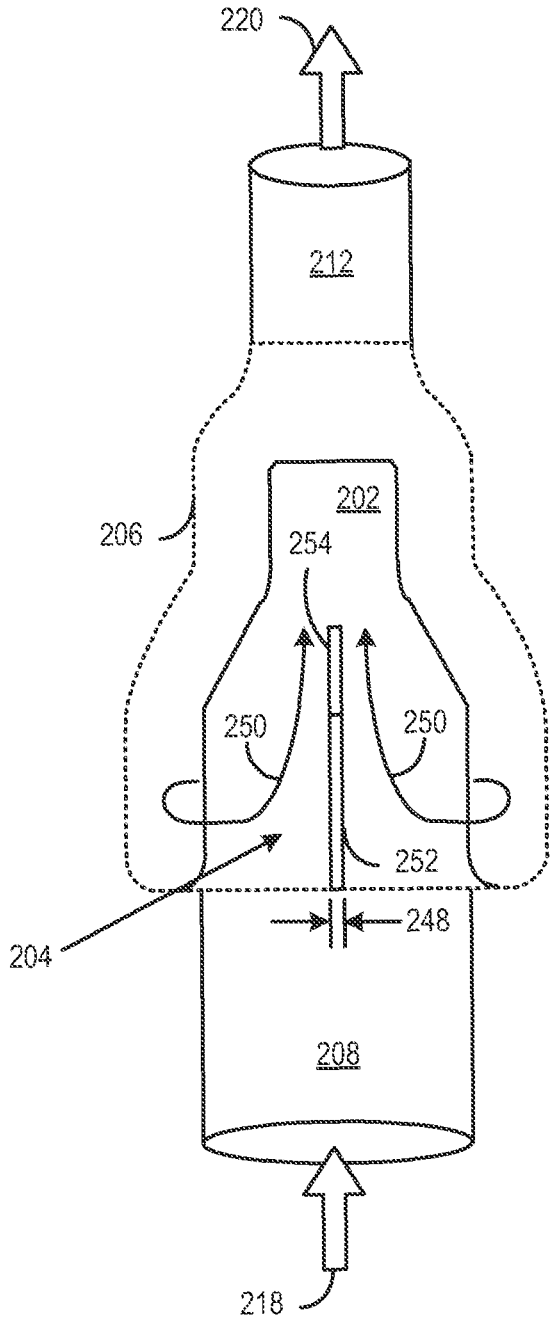
FIG. 3 shows a bottom perspective view of the example jet pump nozzle assembly of FIG. 2.
Figure 4:
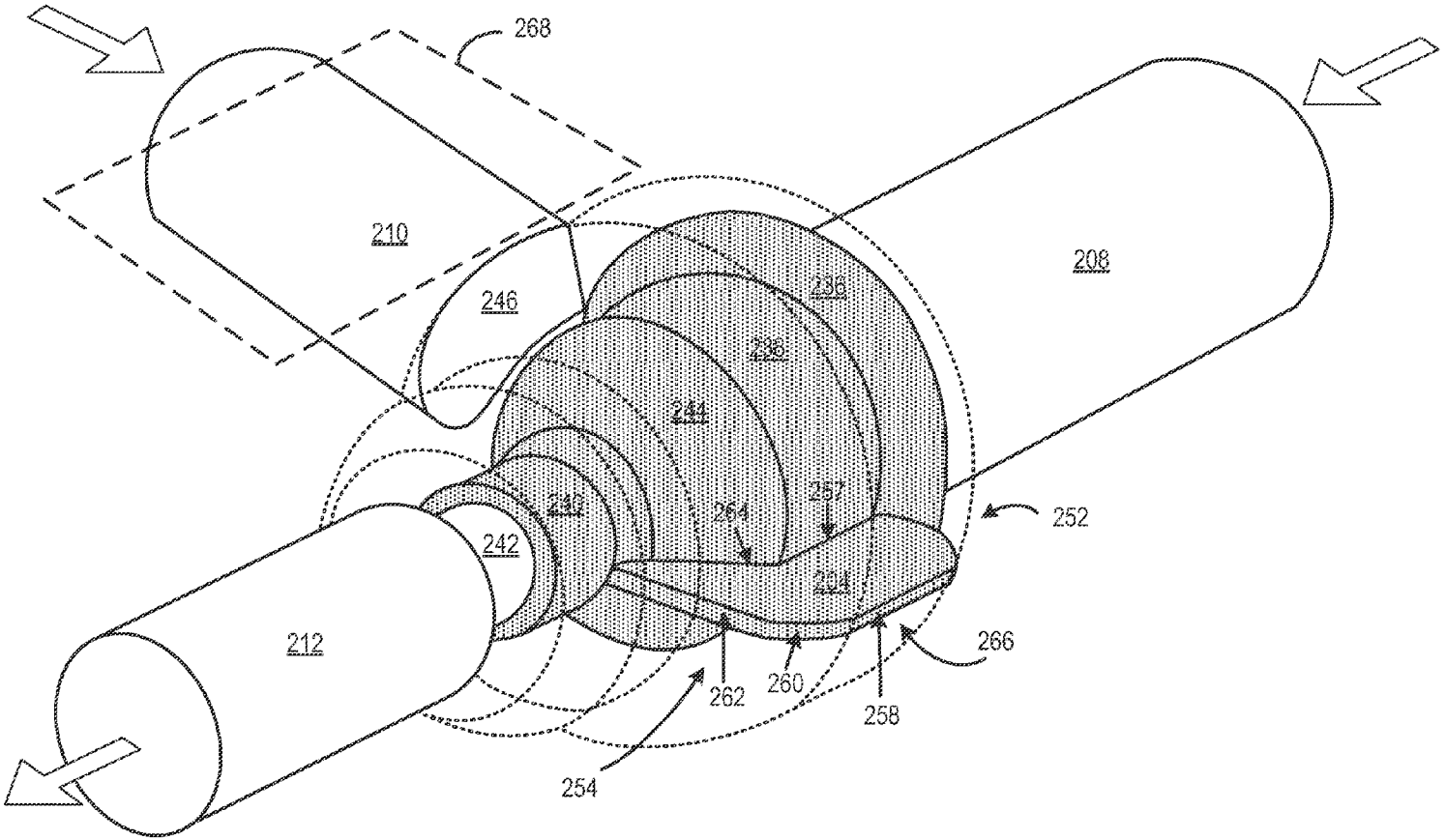
FIG. 4 shows another perspective view of the example jet pump nozzle assembly of FIG. 2.

FIG. 2 shows a side perspective view of an example jet pump assembly 200 according to an embodiment of the present disclosure. Jet pump assembly 200 may be included in coolant system 9 of FIG. 1 to enable pumping, and thus, distribution of coolant to various components of engine 10. FIG. 3 shows a bottom perspective view of jet pump assembly 200 and FIG. 4 shows another perspective view of jet pump assembly 200. It will be appreciated that FIGS. 2-4 may include similar components and such components are referenced with like numbers.

Referring to FIGS. 2-4, jet pump assembly 200 may include a nozzle 202 and a flow divider 204 positioned within outer casing 206, as shown. Therefore, outer casing 206 may be a housing for jet pump assembly 200. Nozzle 202 may include inner and/or outer walls that are continuous with inner and outer walls of a primary passage 208, for example. As such, nozzle 202 may be a downstream region of primary passage 208. For example, nozzle 202 and primary passage 208 may be regions of a common sleeve. Flow divider 204 may be positioned opposite suction passage 210, as shown. Nozzle 202, flow divider 204, and outer casing 206 will be discussed further below.

Jet pump assembly 200 may be in fluidic communication with primary passage 208, suction passage 210 and an exit passage 212. As shown, primary passage 208 and exit passage 212 may be coaxial, and thus may share a common central axis 214, which may also be referred to herein as a primary flow axis. Further, a central axis 216 of suction passage 210 may be substantially orthogonal to the primary flow axis 214. For example, central axis 216 may be positioned 80-100° from primary flow axis 214. As another example, central axis 216 may be substantially orthogonal such that central axis 216 is positioned 90° from primary flow axis 214. It will be appreciated that central axis 216 may be positioned at other angles from primary flow axis 214.

Fluid, such as coolant, may enter jet pump assembly 200 via primary passage 208 in a direction indicated generally by arrow 218. Further, fluid may exit jet pump assembly 200 via exit passage 212 in a direction indicated generally by arrow 220. Since primary passage 208 and exit passage 212 are coaxial, arrows 218 and 220 may commonly indicate a direction of a primary flow through jet pump assembly. Further, due to the geometric configuration of the jet pump assembly, coolant pumped through the jet pump assembly in the primary flow direction may create a low pressure zone that draws fluid, such as coolant, through suction passage 210 in a direction generally indicated by arrow 222. As such, suctioned fluid may be entrained nearly semi-circumferentially around an exterior of the nozzle 202 prior to entering mixing region 224.

For example, suctioned fluid may be entrained within annular channel 226 prior to entering mixing region 224. As used herein, mixing region 224 refers to a region where fluid from primary passage 208 (e.g., a primary fluid flow) converges with fluid from suction passage 210 (e.g., a suctioned fluid). In this way, suctioned fluid may be drawn into annular channel 226 nearly semi-circumferentially around an exterior surface 228 of jet pump assembly 200.

Annular channel 226 may be formed between exterior surface 228 and outer casing 206. In other words, annular channel 226 may be a void between exterior surface 228 and outer casing 206 that forms circumferentially around jet pump assembly 200, for example. Further, outer casing 206 may follow a contour of nozzle 202 such that annular channel 226 is maintained. Therefore, outer casing 206 and nozzle 202 may have a similar geometric configuration such that the spacing between exterior surface 228 and outer casing 206 is consistent circumferentially and consistent along primary flow axis 214, for example. However, as described in more detail below, flow divider 204 may be positioned within annular channel 226 such that the flow divider inhibits suctioned fluid from flowing 360° around exterior surface 228 of jet pump assembly 200.

In this way, each portion of nozzle 202 may have a particular geometric shape that is matched by a corresponding portion of outer casing 206. However, to maintain annular channel 226 each portion of outer casing 206 may have a greater diameter, and thus a greater cross sectional area than each corresponding portion of nozzle 202. Further, there may be a constant relationship between the cross sectional area of the outer casing and the cross sectional area of the nozzle such that the cross sectional areas of both the outer casing and the nozzle decrease proportionally in a primary fluid flow direction. As such, an upstream side of both outer casing 206 and nozzle 202 may have a larger cross sectional area of a downstream side of both outer casing 206 and nozzle 202 while maintaining annular channel 226. However, some portions of outer casing 206 and nozzle 202 may not overlap. For example, outer casing 206 may extend beyond an end of nozzle 202. In such a scenario, outer casing 206 may have a cross sectional area that is substantially greater than an upstream region where outer casing 206 and nozzle 202 have portions that align with each other. This region downstream from an end of nozzle 202 that is encased by outer casing 206 may be a mixing region 224, for example.

Primary fluid flow injected through nozzle 202 and suctioned fluid entrained through annular channel 226 may converge within mixing region 224, as introduced above. It will be appreciated that while mixing region 224 indicates a mixing of more than one fluid, the fluids may be the same fluid, or the fluids may be different fluids. As another example, the fluids may be the same fluid but may have different fluid properties. For example, two fluids may originate from two different sources and may have different thermal properties. Thus, mixing region 224 may be a region that indicates a mixing of different thermal properties rather than a mixing of different fluids, for example. Therefore, the fluids with different thermal properties may mix such that the fluids approach one or more common thermal properties. For example, fluid downstream from mixing region 224 may have a consistent temperature due to proper mixing. In this way, the primary fluid flow downstream from mixing region 224 may have homogeneous fluid properties throughout a given cross sectional are of the fluid flow. For example, the suctioned fluid may have a lower temperature than the primary flow fluid, and the two fluids may mix to approach a homogenous temperature. As another example, the suctioned fluid may have a higher temperature than the primary flow fluid, and the two fluids may mix to approach a homogeneous temperature. In this way, mixing region 224 may indicate a region where two fluids with different thermal properties converge.

Exit passage 212 may be a conduit for the mixed fluid to be entrained away from jet pump assembly 200. For example, exit passage 212 may be a conduit that enables coolant to be distributed throughout the engine to regulate temperature of one or more components of the engine. As shown, exit passage 212 may be coupled to outer casing 206. Further, outer casing 206 may be coupled to both exit passage 212 and suction passage 210. Therefore, one or more surfaces of outer casing 206 may be continuous with one or more surfaces of one or both of exit passage 212 and suction passage 210. Further, outer casing 206 may be welded, or otherwise attached, to primary passage 208. Further, jet pump assembly 200 may be inserted within an interior of outer casing 206 such that annular channel 226 is maintained.

As introduced above, jet pump assembly 200 may include nozzle 202 and flow divider 204 positioned within outer casing 206.

As shown in FIGS. 2-4, nozzle 202 may include one or more portions. For example, nozzle 202 may include an upstream portion 230, a downstream portion 232, and a middle portion 234 positioned between upstream portion 230 and downstream portion 232.

Upstream portion 230 may include a mating interface 236 for mating the jet pump assembly to primary passage 208. For example, an inner surface of mating interface 236 may be coupled with an exterior surface of primary passage 208. In this way, primary passage 208 may be positioned within a portion of the jet pump assembly 200, for example, inside a portion coinciding with mating interface 236. Upstream portion 230 may also include a first hollow cylinder portion 238 with an inner diameter that is substantially equal to an inner diameter of primary passage 208. Further, upstream portion 230 may be coupled to a divider portion of flow divider 204, which will be discussed further below.

Downstream portion 232 may include a second hollow cylinder portion 240 and an opening 242. Second hollow cylinder portion 240 may have a smaller inner diameter than first hollow cylinder portion 238. Therefore, second hollow cylinder portion 240 may also have a smaller inner diameter than primary passage 208.

Opening 242 may enable fluid to be released from jet pump assembly 200. For example, the primary fluid flow may flow through jet pump assembly 200 such that the primary fluid enters jet pump assembly 200 at upstream portion 230 and exits jet pump assembly 200 through opening 242 at downstream portion 232.

Middle portion 234 may include a hollow conical frustum portion 244. Further, middle portion may be coupled to a streamline portion of flow divider 204, which will be discussed further below. Hollow conical frustum portion 244 may be a transition region between the first and second hollow cylinders. Thus, hollow conical frustum portion 244 may have an upstream inner diameter that is substantially equal to the inner diameter of first hollow cylinder 238, and a downstream inner diameter that is substantially equal to the inner diameter of the second hollow cylinder 240. Therefore, the hollow conical frustum may have a circumferential surface coupled to the first and second hollow cylinders such that the inner diameter of the hollow conical frustum decreases from the inner diameter of the first hollow cylinder to the inner diameter of the second hollow cylinder in the primary fluid flow direction. In this way, middle portion 234 may be a transition region of nozzle 202.

It will be appreciated that nozzle 202 may include one or more other regions than those described above. Further, the one or more regions of nozzle 202 may form any suitable geometric structure without departing for the scope of this disclosure. Thus, nozzle 202 is provided by way of example to generally illustrate a concept of reducing a cross sectional flow area of the primary fluid flow passing through jet pump assembly 200. As such, one or more regions of the aforementioned portions may be a constricting region that constricts fluid flow flowing through nozzle 202.

For example, one or more constricting regions may have a cross sectional area that is smaller than an upstream cross sectional area of jet pump assembly 200 and/or primary passage 208. As shown, nozzle 202 generally includes two constricting regions coinciding with hollow conical frustum 244 and second hollow cylinder 240.

As shown, hollow conical frustum 244 may have a cross sectional area that decreases gradually in a downstream direction. In other words, hollow conical frustum 244 may be a transition region that constricts fluid flow between first hollow cylinder region 238 and second hollow cylinder region 240.

As shown, second hollow cylinder 240 may further constrict fluid flow since second hollow cylinder 240 has a cross sectional area that is substantially smaller than a cross sectional area of primary passage 208, for example. As shown, second hollow cylinder 240 may have a constant inner diameter; therefore, second hollow cylinder 240 may have a constant cross section area.

It will be appreciated that nozzle 202 may include more constricting regions than those described. Further, nozzle 202 may include fewer constricting regions than those described. Further still, the one or more constricting regions may have any suitable structure that enables fluid flow constriction. In this way, fluid flowing from primary passage 208 into nozzle 202 may increase in fluid flow velocity due to the constricting regions.

As best shown in FIGS. 2 and 4, flow divider 204 may be positioned within annular channel 226 on a side of jet pump assembly 200 that is opposite from an opening 246 of suction passage 210. In other words, flow divider may be positioned 180° from opening 246 about primary flow axis 218. Said in another way, nozzle 202 may be positioned between flow divider 204 and opening 246, such that suctioned fluid is entrained nearly semi-circumferentially around nozzle 202 prior to being diverted by flow divider 204. In this way, flow divider 204 may be in a position that enables streamlining of the suctioned fluid flow.

As best shown in FIG. 3, flow divider may have a width 248 that is substantially smaller than a diameter of nozzle 202. For example, width 248 may be substantially smaller in dimension than the inner diameter of upstream portion 230. Further, width 248 may be substantially smaller in dimension than the various inner diameters of middle portion 234. Further still, width 248 may be substantially smaller in dimension than the inner diameter of downstream portion 232.

Flow divider 204 may influence a suctioned fluid flow pathway around nozzle 202. For example, suctioned fluid may generally flow from suction passage 210, nearly semi-circumferentially around exterior surface 228, and may be diverted to flow substantially parallel to the primary fluid flow. As such, that the suctioned fluid may follow a flow pathway indicated generally by arrows 250, as shown. In this way, flow divider 204 may divert the suctioned fluid flowing around the exterior surface of nozzle 202. Streamlining the suctioned flow may enable enhanced mixing within mixing region 224, as described above.

The particular position as well as the particular geometry of flow divider 204 may enable streamlining of the suctioned flow. As best shown in FIG. 4, flow divider 204 may be an irregular shape such as a fin-like structure that follows at least a portion of a contour of exterior surface 228 of jet pump assembly 200 and at least a portion of a contour of outer casing 206, for example. In other words, flow divider 204 may be a blade, a vane, or similar structure that follows at least a portion of exterior surface 228 and at least a portion of outer casing 206, for example.

As shown in FIGS. 2-4, flow divider 204 may have a first portion 252 and a second portion 254. First portion 252 may be a flow divider portion and second portion 254 may be a streamline portion, for example.

The first portion may be positioned substantially opposite from an opening of suction passage 210, as described above. Further, a length 256 of the first portion may be approximately equal to an inner diameter of suction passage 210 and may substantially align with opening 246 of suction passage 210. In this way, suctioned fluid may flow around nozzle 202 and a flow direction of the suctioned fluid may be changed by the first portion. Therefore, the flow divider may be a blockade, inhibiting suctioned fluid from flowing circumferentially around surface of nozzle 202. As best shown in FIG. 2, the first portion may have a bottom surface 258 that is flush with outer casing 206 within a region of outer casing 206 that corresponds to first hollow cylinder portion 238 of nozzle 202. Since bottom surface 258 is flush with outer casing 206, a gap does not exist between the first portion and the outer casing. Further bottom surface 258 may be parallel to the primary flow axis.

Further, the first portion may include a surface 257 that follows a contour of nozzle 202. As such, surface 257 may follow a contour of an upstream region of nozzle 202, such as first hollow cylinder portion 238, for example. Further, surface 257 may be parallel to bottom surface 258, and thus, parallel to the primary flow axis. In this way, the flow divider portion may be coupled to nozzle 202.

The second portion (e.g. the streamline portion) may be coupled to the second portion (e.g., the flow divider portion), downstream from the first portion. In other words, the first portion may be upstream from the second portion. The second portion may channel the suctioned flow such that the diverted suctioned flow continues in a direction that is substantially parallel to the primary flow direction. In one example, the second portion is a tapered vane structure that follows a contour of the hollow conical frustum portion of nozzle 202. Therefore, the tapered vane structure may follow the contour of the hollow conical frustum portion such that the tapered vane structure is positioned within a plane that is non-parallel to the primary flow direction. In other words, a plane comprising the tapered vane may interest a plane corresponding to the primary flow direction.

As best shown in FIGS. 2 and 4, the second portion may have a bottom surface 260 similar to bottom surface 258. As such, bottom surface 260 may be coupled to outer casing 206 such that no gap exists between flow divider 204 and outer casing 206. In this way, bottom surfaces 258 and 260 may follow a contour of outer casing 206. However, bottom surface 260 may not be parallel to the primary flow axis, unlike bottom surface 258, even though the two bottom surfaces are flush with outer casing 206. For example, bottom surface 260 may be flush with outer casing 206 in a region that corresponds to the hollow conical frustum portion of nozzle 202. Therefore, a plane including bottom surface 260 may be non-parallel to the primary flow direction, and thus, may intersect the primary flow axis. Further, the second portion may include a transition surface 262 that contacts a surface of both outer casing 206 and nozzle 202 such that transition surface 262 tapers. In other words, transition surface 262 may be continuous with bottom surfaces 258 and 260, yet transition surface 262 may extend away from outer casing 206 such that a region downstream from transition surface 262 enables fluid flow 360° around downstream portion 232 of nozzle 202, if desired. Therefore, transition surface 262 may connect the surfaces that follow the contour of outer casing 206 as well as a surface following a contour of nozzle 202, for example. Further, transition surface 262 may be included within a plane that is non-parallel with the primary flow axis. Such a plane may therefore interest primary flow axis 214. Further still, transition surface 262 may have a different slope than bottom surface 260. As one example, transition surface 262 may have a steeper slope than bottom surface 260 using bottom surface 258 as a reference. For example, bottom slope 260 may rise 15-30° from bottom surface 258, and transition surface may rise 30-75° from bottom surface 258, which are provided as non-limiting examples.

Further, the second portion may include a surface 264 that follows a contour of nozzle 202. As such, surface 264 may follow a contour of a constricting region of nozzle 202, such as hollow conical frustum portion 244, for example. Further, a portion of surface 264 may follow the contour of the second hollow cylinder portion 240, for example. Therefore, surface 264 may include a portion that is parallel to the primary flow axis, and a portion that is non-parallel to the primary flow axis. In this way, the second portion may be coupled to nozzle 202.

Collectively, the divider portion and the stream line portion (e.g., first portion 252 and second portion 254) may include fluid contact surfaces 266, for contacting suctioned fluid flow. Fluid contact surfaces 266 may be positioned within a plane that includes primary flow axis 214 and bisects suction passage 210. For example, such a plane may bisect the suction passage such that suction passage 210 includes two portions cut along plane 268 in a direction corresponding to the suctioned fluid flow direction (e.g., as indicated by arrow 222) within suction passage 210. In this way, flow divider is positioned opposite of suction passage opening 246 within annular channel 226. In other words, the nozzle 202 is positioned between flow divider 204 and suction passage 210, along suction passage central axis 216.

It will be appreciated that flow divider 204 is provided by way of example, and thus is not meant to be limiting. As such, flow divider 204 may have another suitable geometry without departing from the scope of this disclosure. For example, flow divider 204 may include a region that follows the contours of downstream portion 232 of nozzle 202. As another example, width 248 of flow divider 204 may taper in a downstream direction such that a downstream end of flow divider comes to a point, to further enhance suctioned flow streamlining.

Further, the inventors herein have recognized that a particular geometric construction of jet pump assembly 200, and further, a particular arrangement between nozzle 202, outer casing 206, primary passage 208, suction passage 210, and exit passage 212 enables enhanced streamlining of the suctioned fluid upstream from mixing region 224, to achieve a higher primary flow rate for a given pressure. In one example, a 10% increase in suction was observed for the same primary flow rate using the jet pump assembly 200 and associated components as described herein.

As best shown in FIG. 3, outer casing 206 may be spaced apart from nozzle 202 by an annular channel height 268. For example, annular channel height 268 may be constant around a periphery of jet pump assembly 200. Further, since outer casing 206 follows the contours of jet pump assembly 200, a value for annular channel height 268 may be constant from an upstream side 270 of annular channel 226 to a nozzle end 272. For example, annular channel height 268 may be 5.0 millimeters, which is provided as one non-limiting example. As another example, annular channel height may be greater than 5.0 millimeters. As yet another example, annular channel height may be less than 5.0 millimeters.

Further, nozzle end 272 may be a distance 274 from suction passage central axis 216. Such a distance may further enable enhanced streamlining of suctioned fluid prior to the suctioned fluid entering mixing region 224, for example. As one non-limiting example, distance 274 may be 21.86 millimeters. As another example, distance 274 may be greater than 21.86 millimeters. As yet another example, distance 274 may be less than 21.86 millimeters.

Further, nozzle end 272 may be a distance 276 from an upstream side 278 of exit passage 212. Such a distance may be associated with at least a portion of mixing region 224. As such, distance 276 may be selected to enable proper mixing of the primary fluid flow and the suctioned fluid. As one non-limiting example, distance 276 may be 7.667 millimeters. As another example, distance 276 may be greater than 7.667 millimeters. As yet another example, distance 276 may be less than 7.667 millimeters.

Further, at nozzle end 272, nozzle 202 may have an inner diameter 280. As shown, nozzle inner diameter 280 may be smaller than exit passage inner diameter 282. Additionally, exit passage inner diameter 282 may be smaller than primary passage inner diameter 284. As non-limiting examples, nozzle inner diameter 272 may be 6.1 millimeters, exit passage inner diameter 282 may be 10.3 millimeters, and primary passage inner diameter 284 may be 15.0 millimeters. However, it will be appreciated that the aforementioned inner diameters may be greater than or less than the examples given above. Further, the nozzle inner diameter to the distance between the nozzle end and the central axis of the suction passage may have a ratio of approximately 0.279 in some embodiments. It will be appreciated that the ratio of the nozzle inner diameter to the distance between the nozzle end and the central axis may be greater than or less than 0.279 to enhance streamlining prior to the mixing region.

Further, it will be appreciated that each component of jet pump assembly may have any suitable wall thickness. The wall thickness of each component may be constant, or the wall thickness may vary. For example, nozzle 202, flow divider 204, outer casing 206, primary passage 208, suction passage 210, and exit passage 212 may have a wall thickness of a similar dimension. As another example, nozzle 202, flow divider 204, outer casing 206, primary passage 208, suction passage 210, and exit passage 212 may each have a different wall thickness. It will be appreciated that some of the aforementioned jet pump assembly components may have a similar wall thickness whereas other components may have a different wall thickness.

It will be appreciate that jet pump assembly 200 is provided by way of example, and thus, is not meant to be limiting. Rather, jet pump assembly 200 is provided as a general example for streamlining fluid flow through a jet pump nozzle. Therefore, it will be appreciated that other geometries are possible without departing from the scope of this disclosure. For example, the flow divider may have any suitable shape to streamline coolant flow. As another example, the flow divider may be positioned in another location within annular channel. Jet pump assembly 200 may include more than one flow divider, for example.

Furthermore, jet pump assembly 200 may be configured for any suitable fluid distribution system. For example, jet pump assembly 200 may be utilized in a fuel delivery system for distributing fuel to a fuel rail, which is provided as one non-limiting example.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for an engine, comprising:

a primary passage;

a suction passage;

an outer casing coupling the primary and suction passages such that a primary axis is substantially orthogonal to a suction axis; and a jet pump assembly coupled to the primary passage forming an annular channel between the outer casing and the jet pump assembly, the jet pump assembly including a flow divider positioned opposite from the suction passage within the annular channel; and a nozzle coupled to the flow divider and fluidically coupled to the primary passage, the nozzle positioned between the flow divider and the suction passage along the suction axis, the nozzle including one or more constricting regions that constrict a flow of a fluid through the nozzle, the nozzle further including a hollow cylinder portion and a hollow conical frustum portion, wherein the outer casing follows a contour of the hollow cylinder portion and the hollow conical frustum portion, while maintaining the annular channel; and further wherein the flow divider includes a first portion and a second portion, the first portion coinciding with the hollow cylinder portion and the second portion coinciding with the hollow conical frustum portion.

2. The system of claim 1, wherein the nozzle includes an opening that releases the fluid to a mixing region within the outer casing, and wherein an inner diameter of the nozzle and a nozzle end distance from a central axis of the suction passage has a ratio of approximately 0.279 to increase streamlining prior to the mixing region.

3. The system of claim 1, wherein the flow divider includes a surface that follows contours of the hollow cylinder portion and the hollow conical frustum portion.

4. The system of claim 1, wherein the flow divider includes a surface that follows a contour of the outer casing.

5. The system of claim 2, wherein the flow divider is coupled to the outer casing in an upstream region coinciding with the hollow cylinder portion such that a gap is not formed between the flow divider and the outer casing.

6. The system of claim 5, wherein the upstream region is a flow divider portion of the flow divider, the flow divider portion aligned with a suction passage opening such that the suction passage opening is positioned 180 degrees around the nozzle from the flow divider portion.

7. The system of claim 3, wherein the flow divider includes an upstream portion coupled to the hollow cylinder portion and a downstream portion coupled to the hollow conical frustum portion.

8. The system of claim 7, wherein the downstream portion is a streamlined portion, the streamlined portion including a tapered vane with two fluid contact surfaces that converges a suction passage fluid flow direction to a primary passage fluid flow direction.

9. A jet pump assembly, comprising:

a nozzle including a constricting portion and a cylindrical portion;

an outer casing housing the nozzle to form an annular channel therebetween; and a flow divider including a first surface that follows a contour of the constricting portion, a second surface that follows a contour of the cylindrical portion, a transition point that connects the first and second surfaces, and two fluid contact surfaces orthogonal to the constricting portion and the cylindrical portion.

10. The assembly of claim 9, wherein the constricting portion includes a hollow conical frustum portion and the outer casing follows a contour of the hollow conical frustum portion to maintain the annular channel.

11. The assembly of claim 10, wherein the fluid contact surfaces include a tapered vane that follows the contour of the hollow conical frustum portion.

12. The assembly of claim 11, wherein the jet pump assembly is fluidically coupled to a primary flow passage and an exit flow passage that are coaxial with the nozzle, the outer casing fluidically coupled to a suction flow passage, the suction flow passage including an opening that is positioned 180 degrees around the nozzle from the flow divider, the opening releasing a fluid to the annular channel such that the fluid is entrained around the nozzle, a flow pathway of the fluid diverted by a divider portion of the flow divider, the flow pathway including a direction that is a streamline direction due to the tapered vane, wherein the tapered vane is downstream from the divider portion.

* * * * *